US005502848A

United States Patent [19]

Cowan

[11] Patent Number: 5,502,848

[45] Date of Patent: Apr. 2, 1996

[54] PORTABLE GARDEN WORK STATION

[76] Inventor: James P. Cowan, 14642 N. 83rd St., Longmont, Colo. 80503

[21] Appl. No.: 340,275

[22] Filed: Nov. 15, 1994

[51] Int. Cl.[6] ..... A47K 1/04; A47K 1/08

[52] U.S. Cl. ..... 4/619; 4/628; 4/638; 4/646; 4/653; 4/654; 4/661

[58] Field of Search ..... 4/619, 628, 638, 4/643, 646, 648, 650, 653, 654, 661

[56] References Cited

U.S. PATENT DOCUMENTS

| | | | |
|---|---|---|---|
| 412,499 | 10/1889 | Hamilton | 4/628 |
| 798,454 | 8/1905 | Scanlan | 4/638 |
| 1,442,391 | 1/1923 | Filipache | 4/643 |
| 1,834,144 | 12/1931 | Coderre et al. | 4/646 |
| 3,018,490 | 1/1962 | Eichorst | 4/646 |
| 3,324,483 | 6/1967 | Conroy | 4/638 |
| 3,748,437 | 7/1973 | Keeshin et al. | 219/214 |
| 3,828,373 | 8/1974 | Fraley | 4/646 |

FOREIGN PATENT DOCUMENTS

| | | | |
|---|---|---|---|
| 1459600 | 8/1969 | Germany | 4/643 |

*Primary Examiner*—Henry J. Recla
*Assistant Examiner*—Charles R. Eloshway

[57] ABSTRACT

A portable wash basin stand for use outdoors that uses a common garden hose as a water connection between the stand and the nearest plumbing. The stand has a circular weighted base and four upright posts that support a sink. Arrayed on the upright posts are a number of bayonet mounts that can be used to support a variety of accessories including a garden umbrella, a paper towel dispenser, a paper cup dispenser, a soap dispenser, a working shelf and other useful accessories.

5 Claims, 2 Drawing Sheets

PORTABLE GARDEN WORK STATION

BACKGROUND OF THE INVENTION

This invention relates to outdoor and garden furniture in general and in particular to a portable water source and work station having multiple accessories useful to a gardener, farmer or one spending a significant amount of time out of doors.

Gardeners, farmers and others who work or play or ply their hobbies out of doors frequently find it convenient or necessary to have a place that they can obtain water for washing or drinking. Often, though they find themselves inconveniently far from a source of water. To compound the problem, it would often be useful to have some sort of work bench or station that they could stand at, where work would be supported and tools or accessories be placed close at hand. An additional problem is that at gatherings or events out of doors such as concerts, sports events, fairs, carnivals, jamborees, large family reunions, and the like there is often provision made for one or more portable toilets, but it would also be desireable to have a source of water for washing up and a basin for doing so.

Thus, it is an objective of the present invention to provide for a stable, sturdy portable station that can provide fresh, potable water far from a source of plumbing or a water tank, and that can also provide a basin for making use of the water, as well as other accessories and amenities that can make life outdoors more pleasant. It is another objective of the present invention to provide for a furniture system that permits a user to configure a portable work station with those accessories that would make it most practical and enjoyable to use, and to place such accessories where they do the user the most good and be most convenient. It is yet another objective of the present invention to provide for a means of readily disposing of waste water from the station.

The present invention meets these objectives by providing for an integrated system that centers around a basin with a faucet that is connected to a source of water by nothing more than a common garden hose, that can efficiently drain waste water away from the station without the need for plumbing, and that can flexibly accommodate a variety of accessories that can be reversibly attached to points on the station convenient to the user. The station of the present invention is also well designed to be used at fairs, parties, picnics, gatherings, concerts or other events that have portable toilets set up to allow persons to wash up or get a drink of water.

SUMMARY OF THE INVENTION

In summary, the invention comprises a water dispensing work station comprising: a weighted base; a plurality of upright posts fixably attached to said base; a water basin fixably attached to and supported by said posts, which basin has a drain hole; a threaded hose inlet fixture fixably attached to said basin, having a diameter and thread size sufficient to have a garden hose threaded onto said hose inlet fixture; a water faucet fixably attached to said basin to enable a user to turn a flow of water on or off as desired; a drainage hose removably attached to said drain hole in said basin, which drainage hose is of sufficient length to carry waste water away from said station a suitable distance before discharging waste water onto the ground; a plurality of fixture mounts that are fixably attached to said upright posts, said mounts capable of receiving a complementary counterpart fixture mount that is fixably attached to a desired accessory for mounting onto said station.

DETAILED DESCRIPTION OF THE PREFERRED EMBODIMENTS

Figure 1:
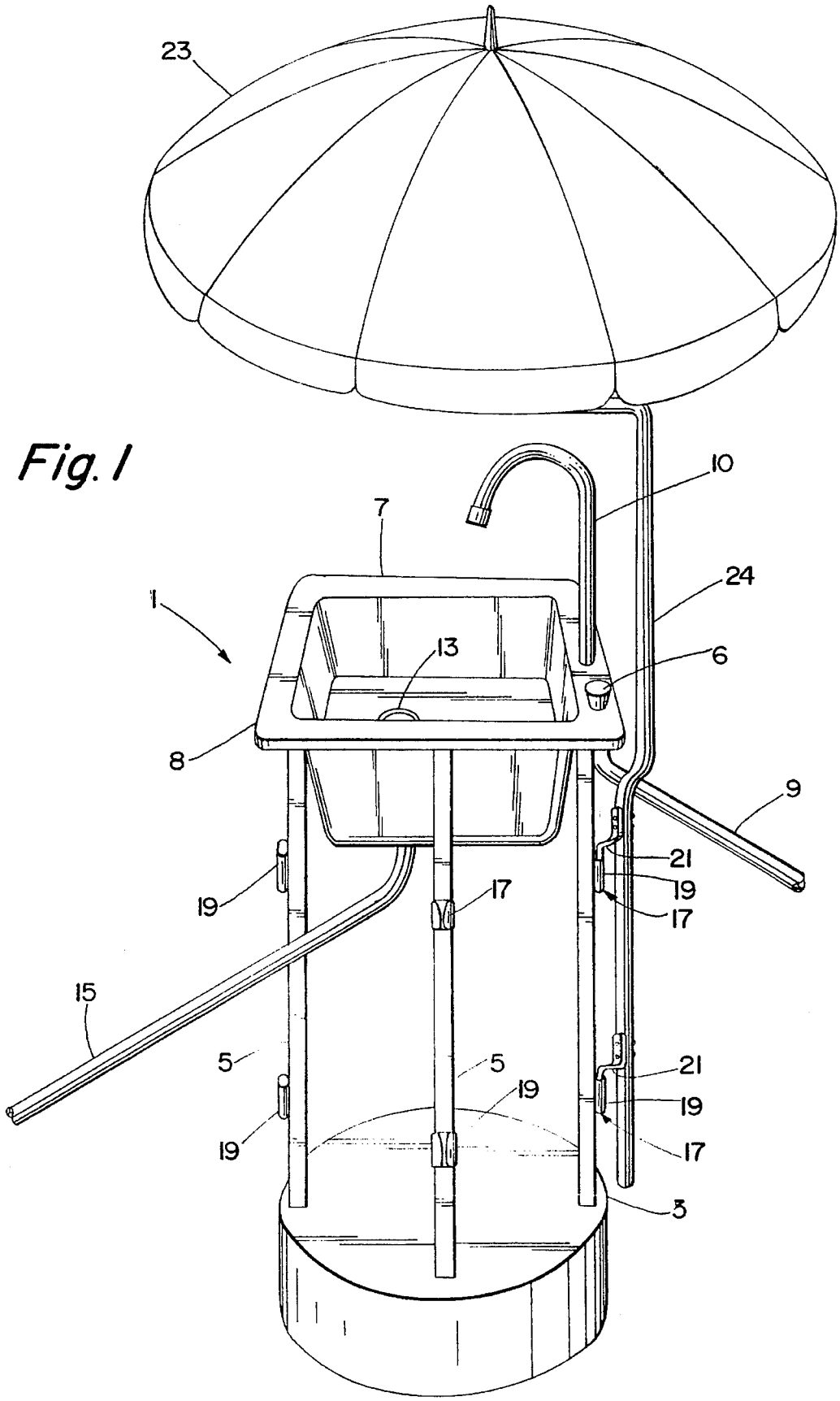
FIG. 1 is a view in perspective showing generally the station of the invention, set up with an inlet hose, a water discharge hose, and several accessories mounts, one of which has mounted within it an umbrella.

At FIG. 1 there is shown generally the portable garden work station 1. The station 1 is anchored or grounded by a base 3 of substantial enough mass to keep station 1 from readily tipping or falling over, or from being blown over by wind. In this regard, the weighted base 3 can be assisted by suitable multiple guy lines that are attached to points on the station 1 and are anchored in the ground by stakes, pegs or the like, and which guy line can be tightened with turnbuckles as needed. The base 3 is preferably round, and can be solid iron, or a cannister made of iron, steel, aluminum or plastic, any of which can be filled with sand, water or concrete. Additionally, the base 3 can have mounted on its bottom side a spike that drives into the ground, which additionally helps to keep the station in place. The spike can be fixably mounted on the bottom of the base 3, or the spike can be run through a hole for that purpose that runs through the thickness of the base, so that the spike can be driven down into the ground by a hammer or mallet from above the base. In another alternative embodiment of the invention, the base can serve as a flower planter by giving the base a sufficiently large concavity to hold a suitable amount of soil.

Attached to base 3 are several upright support posts 5. There are a minimum of three posts 5, and preferably four such posts. The posts 5 are attached to the base by welding or by seating into bores or sleeves in the base for that purpose. In one alternative embodiment, the posts are seated in sleeves welded onto the base, and are locked in place by a set screw that runs through the wall of the sleeve.

Figure 6:
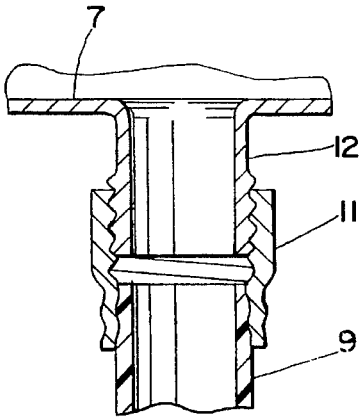
FIG. 6 is a partial cutaway side view of how the water inlet hose threads into a male threaded hose inlet fixture mounted in the sidewall of the sink of the station.

A water inlet hose 9 is shown at FIG. 1, which is for carrying water to station 1. Hose 9 is the source of the water used at the station 1 for drinking, washing or watering plants and flowers at the station. The hose 9 is of any suitable length to connect the station to the nearest water plumbing or storage tank, or can be a series of lengths connected to achieve the necessary distance. Water inlet hose 9 is made up of any suitable polymeric or elastomeric water hose. Although a common garden hose of ⅜ inch, ½ inch or ⅝ diameter is well suitable, the hose industry does make water hoses that are especially designed to carry potable water, being made of polymeric or elastomeric compounds that impart little if any taste to the water, making it especially suitable for drinking. Hose 9 is most preferably threaded into a female threaded mount 11 in the sink 7. In FIG. 6 there is shown such a female threaded mount 11 that is connected in turn to a length of inlet pipe or tube 12. Such female threaded mount can be in the sidewall of sink 7 or in the flange of sink 7, depending on what type of faucet is installed in sink 7. Water inlet hose 9 can be removeably connected to a hose bib 11. A hose bib is a plumbing fixture well known to those of skill in the art as a fixture particularly adapted to the connection of water hoses from a source of plumbing, and is commonly found on an exterior wall of a residential dwelling, where the hose bib provides a male threaded fixture over which the male threaded mounting of a hose is threaded. As an alternative to threaded fittings, garden hose fittings are now commonly available (largely under the brand name Gardena®) that provide for a system of adaptors that thread into and onto threaded firings and which adaptors have O-ring snap-in fittings for quick snap-in and snap-out connections of garden hoses, such adaptors also being well suited to use with the present invention.

Sink or basin 7 is of any suitable material, but, the most preferred material is stainless steel. Sink 7 is characterized by having a bottom with a drainage opening, four sidewalls, a seating flange and openings for mounting a faucet 6. A suitable faucet 6 should have at least one handle or knob for controlling the flow of water from hose 9. Faucet 6 is connected to inlet hose 9 by means of a suitable connector, as discussed above. When properly connected, and when the source of water at the nearest plumbing or water tank is opened, the action of the handle on faucet 6 will control the flow of water into sink 7. An especially well suited faucet will be of the type having a goose necked spout 10, as this will provide a downward flow of water such that the spout will be high enough to permit the placment of flower pots and the like into the sink. Sink 7 is fixably mounted to the upright support posts 5 such that a uniform distribution of weight over the posts results. Sink 7 is preferably seated in a mount 8, which is most preferably a rectilinear framework of the same dimension as the flange of sink 7. Mount 8 is fixably attached to the upright support posts 5 by welding or by suitable hardware such as suitable nuts and bolts, assisted by lock washers or the like. Water is retained in the basin, if necessary, by a suitable plug in the drainage hole or by a mechanical drain closure device built onto the sink, of types well known to those in the plumbing fixture art.

Waste water drainage hose 15 is fitted at one end with a suitable plumbing fitting that permits the hose 15 to be mounted, either fixably or removeably, to the basin drain hole 13. Among means well known to those of ordinary skill in the art are a combination of male and female threaded fixtures, where one part of the set is clamped or fixed by adhesives into the end of hose 15 and then is threaded into or onto a counterpart threaded fixture fixably attached to a hole in the bottom of sink 7. A quick-releasing fitting system can be used alternatively, so that a hand-levered clamp over the end of hose 15 can be clamped onto a protruding nipple fixably mounted in the bottom of sink 7. Another alternative fitting is by the use of an elastomeric 0-ring that is seated into an annular groove around a nipple of one fitting, and which snaps into a suitable counterpart fitting having a complementary annular ring to form a seal with the O-ring.

The waste water drainage hose 15 is most preferably a polymeric or elastomeric hose that is of sufficiently low hose wall thickness that the hose 15 can lie flat when it contains essentially no water. Such a flat hose can then be rolled up and stored underneath the sink 7 by means of a drainage hose clip that clips onto the loose end of the hose, clipping the end onto the rest of the coil, or the coiled hose 15 can be suspended from a drainage hose bracket mounted either underneath sink 7 or mounted onto the interior aspect of one of upright support posts 5. The drainage hose bracket can have a curved support surface of a predetermined arc and width sufficient to hang a coiled drainage hose onto, and can be affixed to an interior aspect of an upright support post or to the underside of the sink by any conventional hardware fastening means. In another version of the invention, the drainage hose can be coiled up by hand cranking a hose wind-up spool, which is made to rotate by the action of a crank turning a spindle running through the center of the wind-up spool, that is mounted to the station 1, either under the sink 7, or to one of the upright support posts 5. Such a windup mechanism is particularly useful when a relatively long length of drainage hose is required to drain water away from where the station is being used to where the waste water is to be discharged. Alternatively, the coiled up drainage hose 15 can be held in its coiled position by an elastomeric band of sufficient circumference to fit around its coiled periphery, or by a belt of sufficient circumference that is engaged by a suitable buckle or Velcro®-like material.

The drainage hose 15 can be perforated at preselected points to allow for a distribution of waste water over a larger area, such as, for example, for draining waste water over an area of lawn or garden that might benefit from the extra water. Furthermore, the far end of hose 15 can be fastened down to the ground by means of a hold down clamp, stake or spike so that the hose does not get moved around by wind, animals or pedestrians. A series of hold-down clamps, spikes or stakes can keep the drainage hose from becoming a danger to pedestrians tripping over it.

Figure 2:
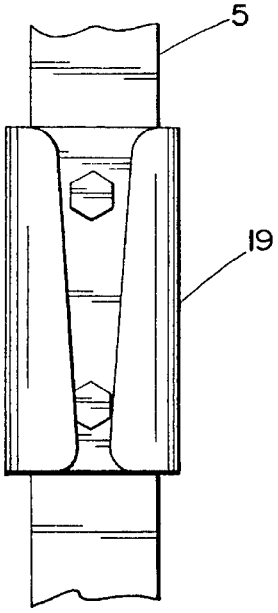
FIG. 2 is a front elevational view of one type of accessory mount that can be used for mounting accessories on the station. This type of mount is a socket bracket.
Figure 3:
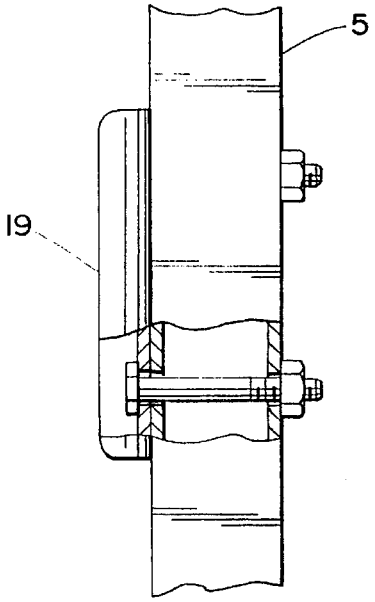
FIG. 3 is a side elevational view of the socket bracket illustrated in FIG. 2.
Figure 4:
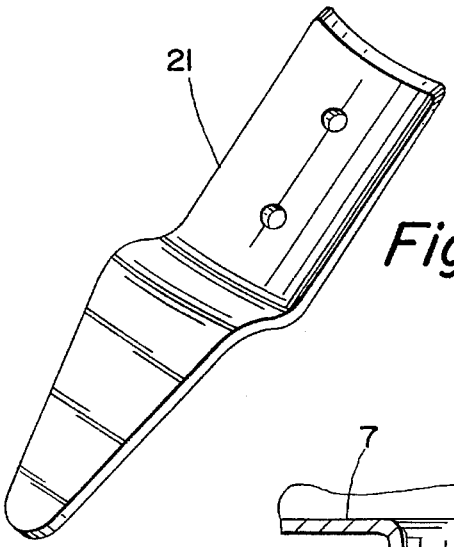
FIG. 4 is a view in perspective of a spade fitting that is adapted to being pushed into the socket bracket of FIG. 2.
Figure 5:
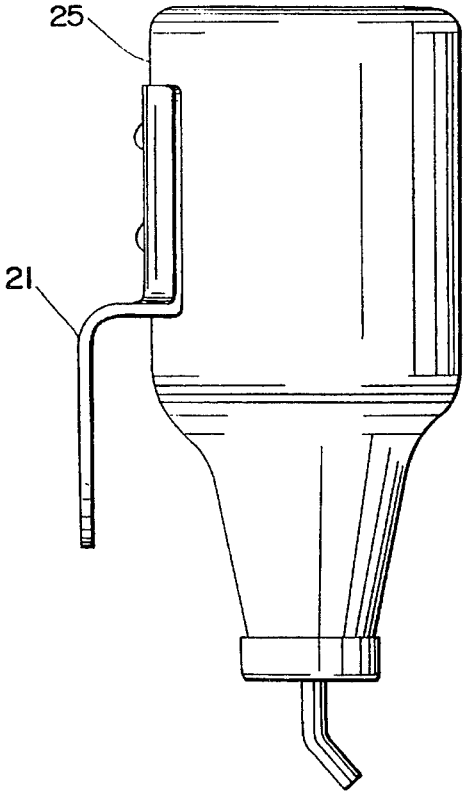
FIG. 5 is a side elevational view of a spade fitting as illustrated in FIG. 4 being bolted to one type of station accessory, in this case a soap dispenser of the type where a user presses the curved lever upwards to release a measured quantity of soap downwards.

The versatility of the station resides in its ability to accommodate a large number of accessories that are attached to the station by its mounting system. The mounting system is made up of a plurality of mounts 17. Each mount is preferably made up of a bayonet-type system of two components, one male and one female. Most preferably, there is illustrated as the female component a socket bracket 19 and the male component as a spade firing 21. A socket bracket is shown in FIGS. 2 and 3, where it can be seen to be a rectangular part whose two sides have been swaged inwards so as to form an angular opening into which a spade fitting is pressed. A spade fitting is shown in FIGS. 4 and 5, where it can be seen to be a flattened article having the necessary perforations for mounting to an accessory of choice on its upper end, while having a lower tapered end that is offset from the upper end by a crank neck. Such hardware is preferred because when properly used in combination, the socket bracket is able to accommodate the spade being pushed downward vertically, such that the spade encounters a progressively narrowing socket bracket, thereby locking the spade in the socket bracket. Although not necessarily the only way that the hardware can be mounted, it is preferred that the socket brackets are fixably mounted onto the upright support posts 5 and that the spade mount is attached to the accessory that is to be attached to the station. Conversely, when it comes time to demount an accessory, the accessory can be removed by applying the necessary force vertically upwards and thus pulling the spade out of the socket bracket. This system permits the user of the station to have the below described accessories mounted at any position that there is a support post 5. Additionally, the socket bracket can be mounted at any desired height on the support post. For larger accessories, such as the umbrella described further below, it may be desireable to have more than one bayonet mount combination, such as having two aligned in a substantially plumb vertical line. Other mounting systems that can be used and that are well known to those of skill in the art include mortise and tenon combinations, keyhole and T-peg combinations, lug and groove combinations, sleeve and set screw combinations, and socket and plug combinations.

The first such accessory is the sun and rain umbrella 23. Such as umbrella can keep direct sunlight off a gardener working at the station, or rainfall, as the case may be. As exemplified here, the umbrella 23 is attached to the station 1 by a pair of vertically plumb mounts 17 at two spots on an upright support post 5. The umbrella is of the type that can be raised and lowered. Bright colors for such an umbrella add to the general attractiveness of the station. Another accessory is a soap dispenser 25, which is used to dispense solid or liquid soap to wash the hands at the station. The soap dispenser 25 is mounted onto an upright support by means of the previously described bayonet mount system. Another useful accessory is a paper towel dispenser, whereby multiple paper towels can be stored for drying the hands or blotting up water or wiping down an article being worked on at the station. This is likewise attached by means of the bayonet system. Other accessories attached by the bayonet system include a hose holding bracket, which can be used to hold the water source inlet hose 9; a disposable cup dispenser, which can be used to hold drinking water cups; an auxiliary work surface, which can be used to hold potted plants being worked on, or food being cleaned and prepared, or condiments for a picnic or the like, and which can be swung up when being used and down when not in use, and which can have molded onto its surface channels to aid in draining away water into the basin; an outdoor thermometer, which will be more accurate if its in the shade of the station's umbrella, and which can be mounted on a support post 5 or on the umbrella's support post 24; and a tool or implement rack for gardening tools or kitchen utensils. The common element to each of the aforedescribed accessories is their ability to be reversibly mounted on the station 1 where and when the user desires it. An additional accessory that is not, however, mounted on one of the posts is that of a sink strainer, for the preparation of fruits, vegetables, and the like in the sink.

While the invention has been described and illustrated with reference to certain preferred embodiments thereof, those skilled in the art will appreciate that various changes, modifications and substitutions can be made therein without departing from the spirit and scope of the invention. It is especially to be noted that bayonet systems other than socket brackets and spade fittings are capable of being used to mount accessory fixtures onto the station. It is intended, therefore, that the invention be limited only by the scope of the claims which follow, and that such claims be interpreted as broadly as possible.

What is claimed is:

1. A water dispensing work station comprising:

(a) a base;

(b) a plurality of upright posts fixably attached to said base;

(c) a water basin fixably attached to and supported by said posts, which basin has a drain hole;

(d) a hose inlet fixture fixably attached to said basin, having a size sufficient to have a garden hose threaded onto said hose inlet fixture;

(e) a water faucet fixably attached to said basin to enable a user to turn a flow of water from said hose inlet fixture on or off as desired;

(f) a drainage hose removably attached to said drain hole in said basin, which drainage hose is of sufficient length to carry waste water away from said station a suitable distance before discharging waste water onto the ground; and (g) a plurality of fixture means that are fixably attached to said upright posts, said means capable of receiving a complementary counterpart fixture means that is fixably attached to a desired accessory for mounting onto said station; and (h) an umbrella having fixably attached to an associated umbrella post a complementary counterpart fixture means, whereby said umbrella is releasably received by a fixture means on a post of said station.

2. The station as claimed in claim 1, wherein said accessory is a soap dispenser having fixably attached thereto a complementary counterpart fixture means that enables said soap dispenser to slidably attach to a further means as a post of said station.

3. A water dispensing work station comprising:

(a) a weighted base;

(b) a plurality of upright posts fixably attached to said base;

(c) a water basin fixably attached to and supported by said posts, which basin has a drain hole;

(d) a threaded hose inlet fixture fixably attached to said basin, having a diameter and thread size sufficient to have a garden hose threaded onto said hose inlet fixture;

(e) a water faucet fixably attached to said basin to enable a user to turn a flow of water from said hose inlet fixture on or off as desired;

(f) a drainage hose removably attached to said drain hole in said basin, which drainage hose is of sufficient length to carry waste water away from said station a suitable distance before discharging waste water onto the ground;

(g) a plurality of bayonet mounts that are fixably attached to said upright posts, said mounts capable of receiving a complementary bayonet counterpart fixture mount that is fixably attached to a desired accessory for mounting onto said station; and, (h) an umbrella having fixably attached to an associated umbrella post a complementary bayonet counterpart fixture mount, whereby said umbrella is releasably received by said bayonet mounts on a post of said station.

4. The station as claimed in claim 3, wherein said complementary bayonet counterpart fixture is a spade fitting.

5. The station as claimed in claim 3 wherein said bayonet mounts are socket brackets.

* * * * *